US011087684B1

(12) United States Patent
Hsiao

(10) Patent No.: US 11,087,684 B1
(45) Date of Patent: Aug. 10, 2021

(54) PIXEL DRIVER AND PIXEL DRIVING METHOD

(71) Applicant: NOVATEK Microelectronics Corp., Hsinchu (TW)

(72) Inventor: Sheng-Wen Hsiao, Changhua County (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 16/850,025

(22) Filed: Apr. 16, 2020

(51) Int. Cl.
*G09G 3/3233* (2016.01)

(52) U.S. Cl.
CPC ... *G09G 3/3233* (2013.01); *G09G 2320/0233* (2013.01)

(58) Field of Classification Search
CPC ..... G09G 3/3233; G09G 2320/0233
See application file for complete search history.

(56) References Cited

U.S. PATENT DOCUMENTS 10,217,410 B2 2/2019 Moon
10,417,961 B2 9/2019 Xiang et al.
2017/0365215 A1* 12/2017 He ..... G09G 3/20
2018/0122297 A1* 5/2018 Nonaka ..... G09G 3/3233
2018/0166021 A1* 6/2018 Xi ..... G09G 3/3233
2018/0240399 A1* 8/2018 Lin ..... G09G 3/32
2018/0315374 A1* 11/2018 Zhang ..... G09G 3/3258

FOREIGN PATENT DOCUMENTS

CN 106652903 A 5/2017
CN 107909966 A 4/2018
CN 108877685 A 11/2018
TW M493127 U 1/2015

* cited by examiner

*Primary Examiner* — Jeff Piziali
(74) *Attorney, Agent, or Firm* — CKC & Partners Co., LLC

(57) ABSTRACT

A pixel driver includes a driving circuit, a data input circuit, a first switch circuit and a second switch circuit. A driving circuit is configured to provide a driving current to drive a pixel element during an emission period. A data input circuit is electrically coupled to the driving circuit, and is configured to receive a data voltage during a data input period. A first switch circuit is electrically coupled to the driving circuit. The first switch circuit is turned on to provide a first voltage to the driving circuit during the data input period. A second switch circuit is electrically coupled to the driving circuit. The second switch circuit is turned on to provide a second voltage to the driving circuit during the emission period, and the first switch circuit is turned off during the emission period.

13 Claims, 11 Drawing Sheets

PIXEL DRIVER AND PIXEL DRIVING METHOD

BACKGROUND

Technical Field

The present disclosure relates to a pixel driver, especially a circuit for driving a pixel element such as a light emitting diode.

Description of Related Art

A pixel driver in the display panel drives a light emitting element (e.g., OLED) through a power source, and the light emitting element generates brightness corresponding to a data signal. However, since the power source has noise due to the interference of the load, the compensation voltage in the pixel driver will be affected by the noise, so that the light emitting element cannot generate the expected brightness correctly.

SUMMARY

One aspect of the present disclosure is a pixel driver, including a driving circuit, a data input circuit, a first switch circuit and a second switch circuit. The driving circuit is configured to provide a driving current to drive a pixel element during an emission period. The data input circuit is electrically coupled to the driving circuit, and configured to receive a data voltage during a data input period. The first switch circuit is electrically coupled to the driving circuit, wherein the first switch circuit is turned on to provide a first voltage to the driving circuit during the data input period. The second switch circuit is electrically coupled to the driving circuit. The second switch circuit is turned on to provide a second voltage to the driving circuit during the emission period, and the first switch circuit is turned off during the emission period.

Another aspect of the present disclosure is a pixel driving method, including: turning on a first switch circuit to transmit a first voltage to a driving circuit during a data input period, receiving a data voltage during the data input period by a data input circuit, turning off the first switch circuit and turning on a second switch circuit to transmit a second voltage to the driving circuit during an emission period, and providing a driving current to drive a pixel element according to the data voltage and the second voltage.

Another aspect of the present disclosure is a pixel driver, including a driving circuit, a data input circuit, a first switch circuit and a second switch circuit. The driving circuit is electrically coupled to a pixel element. The data input circuit is electrically coupled to a control terminal of the driving circuit. The first switch circuit is electrically coupled to a first terminal of the driving circuit. The second switch circuit is electrically coupled to the first terminal of the driving circuit. When the first switch circuit is turned on and the second switch circuit is turned off, the data input circuit is configured to receive a data voltage. When the first switch circuit is turned off and the second switch circuit is turned on, the driving circuit is configured to provide a driving current to drive the pixel element.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

Figure 1A:
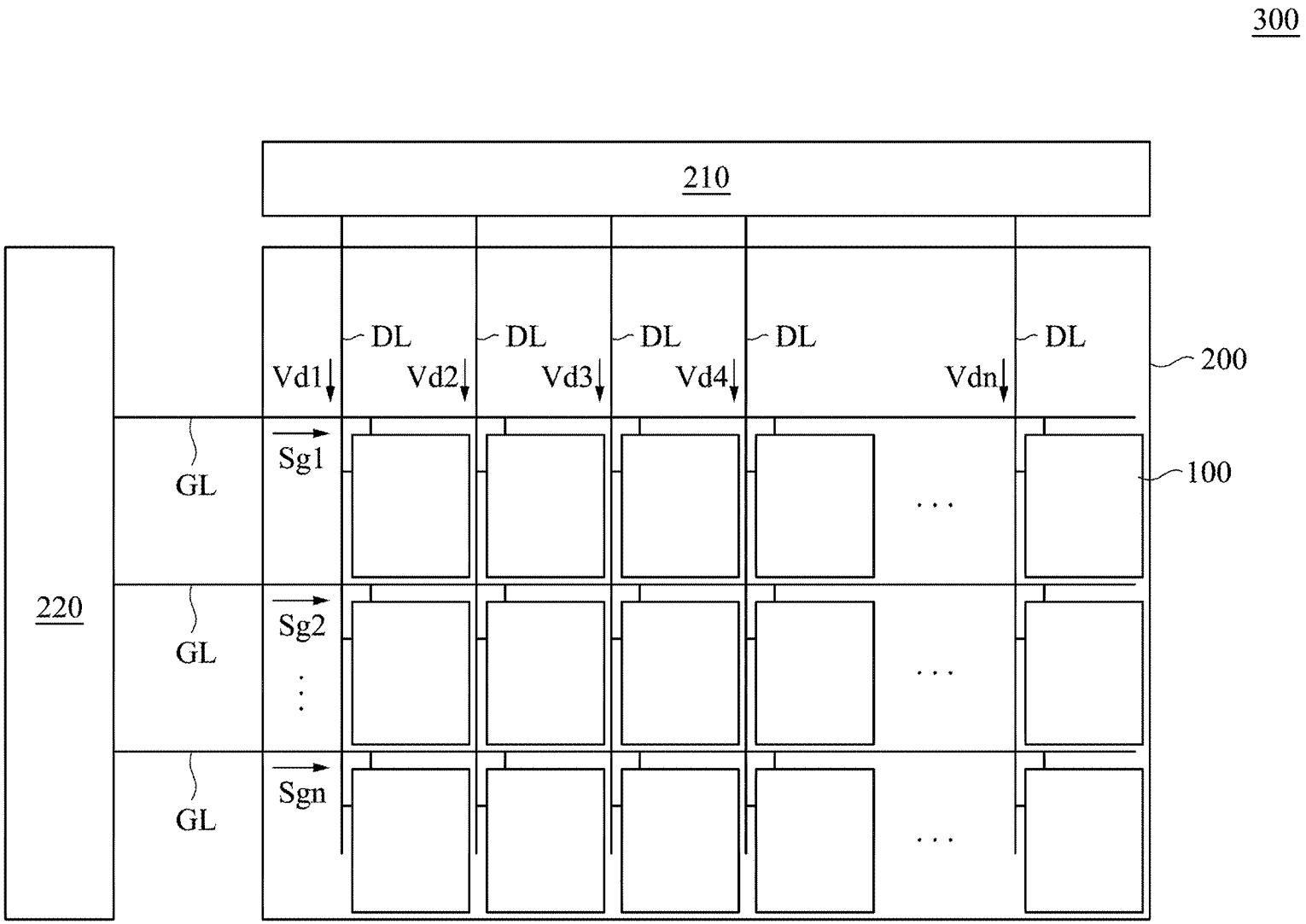
FIG. 1A is a schematic diagram of a display device in some embodiments of the present disclosure.
Figure 1B:
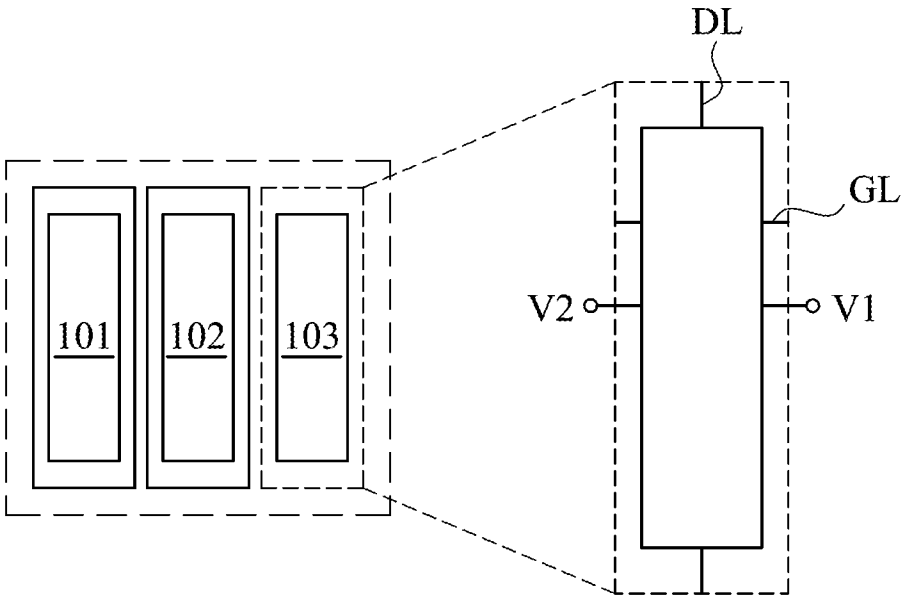
FIG. 1B is a schematic diagram of a pixel element in some embodiments of the present disclosure.

Refer to FIG. 1A and FIG. 1B, the present disclosure relates to a pixel driver 100 and a pixel driving method. In some embodiments, the pixel driver 100 is applied to a display device 300. The display device 300 includes a display panel 200, a source driver 210, a gate driver 220 and multiple pixel drivers 100. The source driver 210 is configured to transmit data signal Vd1-Vdn to the pixel drivers 100 through multiple data lines DL, and the gate driver 220 is configured to transmit scan signal Sg1-Sgn to the pixel drivers 100 through multiple gate lines GL, so that the pixel drivers 100 drives pixel elements (as shown in FIG. 2A) such as light emitting diodes.

In some embodiments, as shown in FIG. 1B, the pixel driver 100 has multiple sub-circuits 101-103 for driving multiple pixel elements of different colors (e.g., Red, Green and Blue). In order to facilitate the technology of the present disclosure, and avoid excessive repetitive circuit structures, FIG. 2A shows a circuit diagram of the pixel driver 100 configured to control one pixel element (corresponding to the sub-circuit 103 in FIG. 1B). The pixel driver 100 is triggered by the scan signal, and drives the internal circuit according to the first voltage V1 and the second voltage V2 to control the pixel element to generate the brightness corresponding to the data signal.

The pixel driver 100 include a driving circuit 110, a data input circuit 120, a first switch circuit 130 and a second switch circuit 140. The driving circuit 110 is configured to provide a driving current le to drive a pixel element P during an emission period. The data input circuit 120 is electrically coupled to the driving circuit 110, and is configured to receive a data voltage Vdata from the data line during a data input period. In some embodiments, the pixel driver 100 sequentially performs initialization(reset), data writing, and emission. The operation process of the circuit is described in the following paragraphs.

Figure 2A:
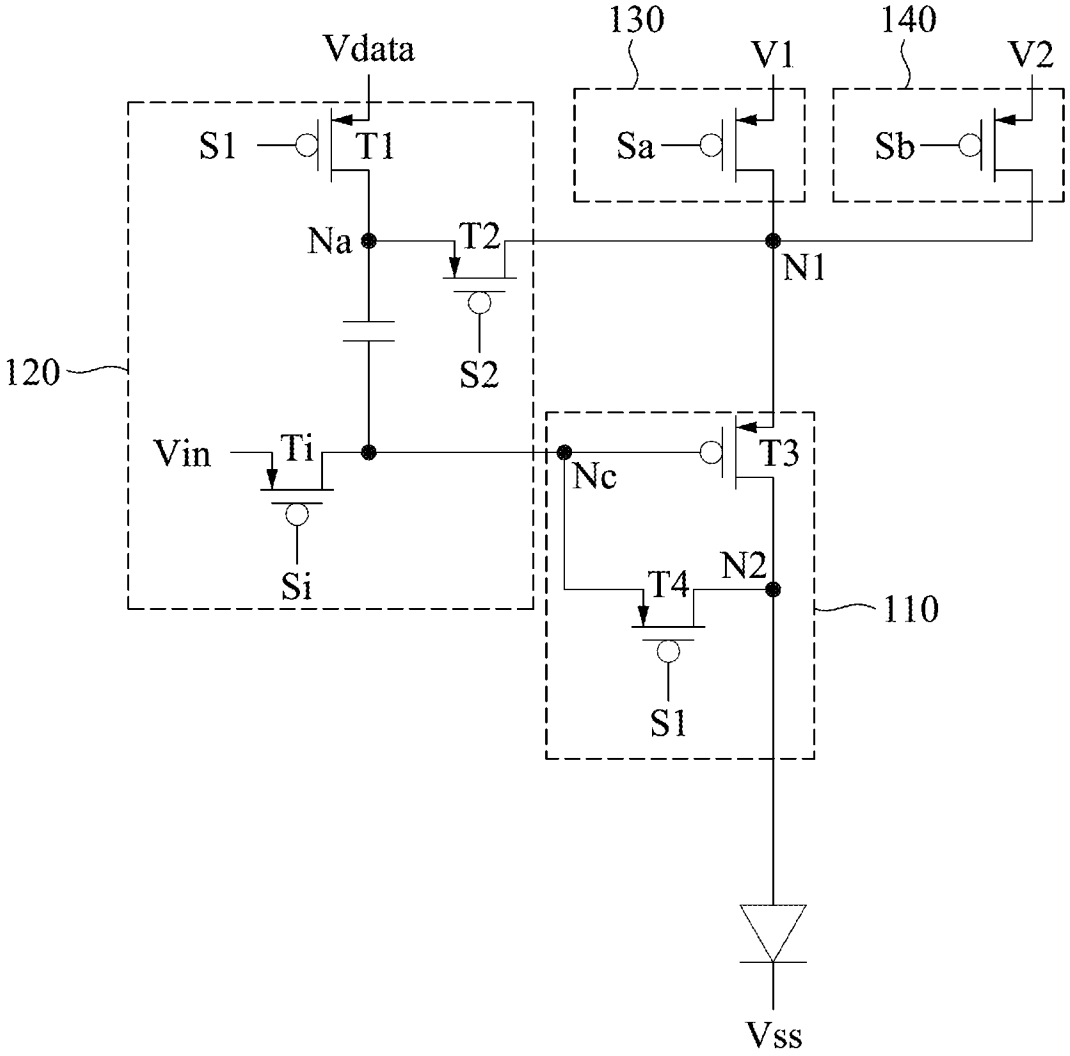
FIG. 2A is a schematic diagram of a pixel driver in some embodiments of the present disclosure.
Figure 2B:
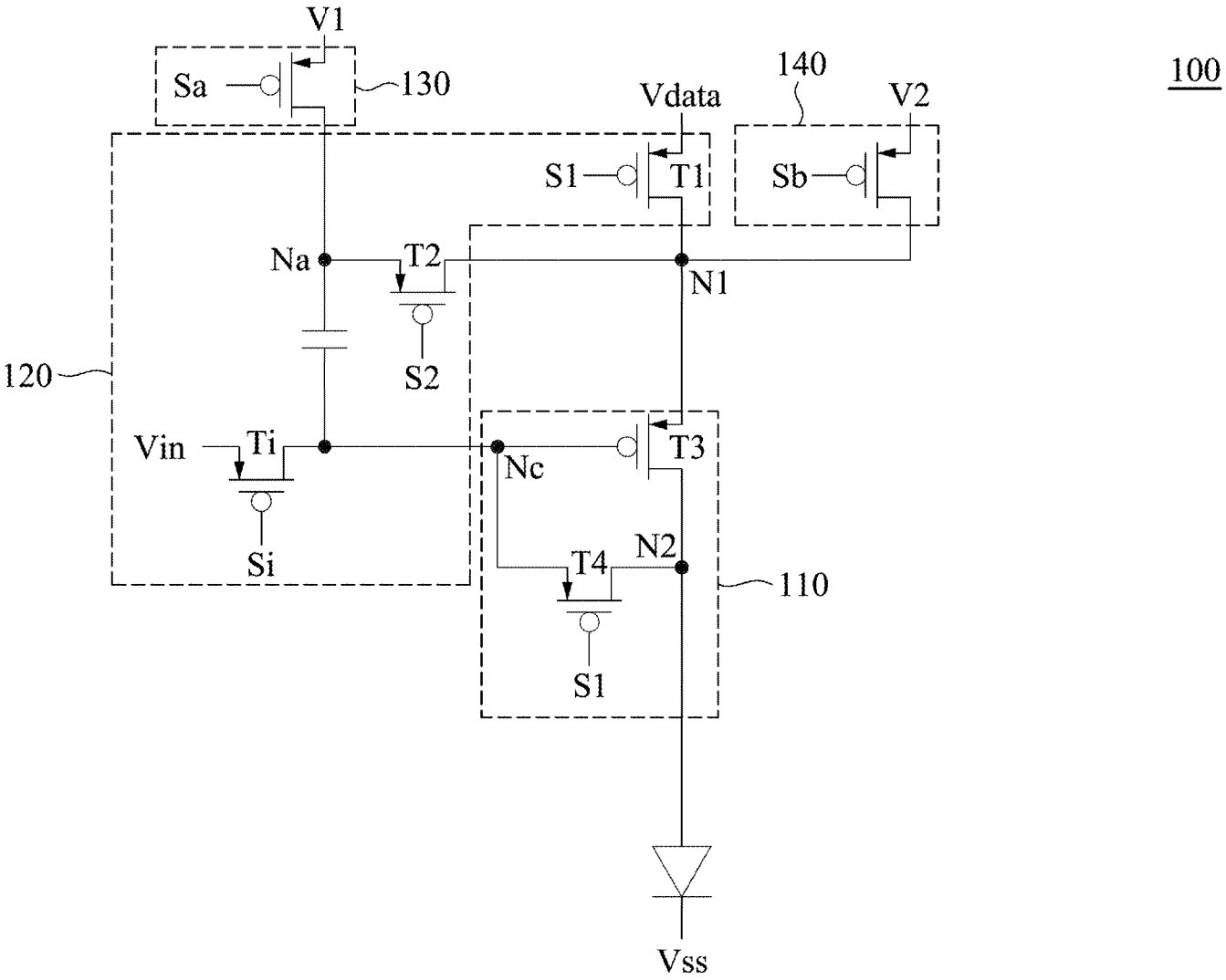
FIG. 2B is another schematic diagram of a pixel driver in some embodiments of the present disclosure.

As shown in FIG. 2A, the first switch circuit 130 is electrically coupled to the driving circuit 110. The first switch circuit 130 is turned on to provide a first voltage V1 to the driving circuit 110 during the data input period. The second switch circuit 140 is electrically coupled to the driving circuit 110. The second switch circuit 140 is turned on to provide a second voltage to the driving circuit 110 during the emission period, and the first switch circuit 130 is turned off during the emission period. FIG. 2B is another schematic diagram of the pixel driver 100 in some embodiments of the present disclosure, in which the position of the first switch circuit 130 is adjusted.

Accordingly, since the pixel driver 100 uses different power sources (i.e., the first voltage V1, the second voltage V2) to perform data writing/data compensation and drive the pixel element P, respectively, the data input circuit 120 may receive and store the data voltage without being affected by noise from the second voltage V2. In some embodiments, the second voltage V2 is configured to supply power to all pixel elements on the display panel 200. Therefore, if the second voltage V2 is used to supply to the driving circuit 110 or the data input circuit 120 for data writing or data compensation, since the second voltage V2 is supply power to other pixel elements of other pixel driver 100 at the same time, the voltage level of the second voltage V2 has power noise, so that data writing or data compensation will cause errors. The present disclosure use the first voltage V1 for data writing or data compensation, and use the second voltage V2 for driving the pixel element P, so errors from the second voltage V2 can be avoided.

In some embodiment, the operation process of the pixel driver 100 includes an initialize period, a data input period (for data compensation and data writing) and an emission period. In the initialize period and the data input period, the first switch circuit 130 is turned on and the second switch circuit 140 is turned off, the data input circuit 120 is configured to receive a data voltage and perform data writing and data compensation. In the emission period, the first switch circuit 130 is turned off and the second switch circuit 140 is turned on, the driving circuit 110 is configured to provide a driving current to drive the pixel element P.

In some embodiments, the first switch circuit 130 and the second switch circuit 140 are electrically coupled to a first terminal (node N1) of the driving circuit 110. The data input circuit 120 is electrically coupled to a control terminal (node Nc) of the driving circuit 110. The pixel element P is electrically coupled to a second terminal (node N2) of the driving circuit 110. The driving circuit 110 is configured to adjust the driving current according to a voltage level of the control terminal Nc of the driving circuit 110.

The data input circuit 120 includes a first switch T1, a storage element C1 and a second switch T2. The first switch T1 is turned on to receive the data voltage Vdata during the data input period. The storage element C1 is electrically coupled to the first switch T1 and the control terminal Nc of the driving circuit 110. The storage element C1 is configured to store the data voltage during the data input period through the turned on first switch T1. The second switch T2 is electrically coupled to the storage element C1 and the first terminal of the driving circuit 110. The second switch T2 is turned on during the emission period.

In some embodiments, the pixel driver 100 further includes an initialize switch Ti. The initialize switch Ti is electrically coupled to the storage element C1 and the control terminal Nc of the driving circuit 110. The initialize switch Ti is turned on to receive an initialize voltage Vin during the initialize period before the data input period.

In some embodiments, the driving circuit 110 includes a third switch T3 and a fourth switch T4. The third switch T3 is electrically coupled between the first terminal (node N1) of the driving circuit 110 and the pixel element P. The fourth switch T4 is electrically coupled between a gate terminal of the third switch T3 and a source terminal of the third switch T3.

In some embodiments, the first switch T1 and the fourth switch T4 are controlled by the control signal S1. The second switch T2 is controlled by the control signal S2. The first switch circuit 130 is controlled by the control signal Sa. The second switch circuit 140 is controlled by the control signal Sb. The initialize switch Ti is controlled by the control signal Si.

Figure 3A:
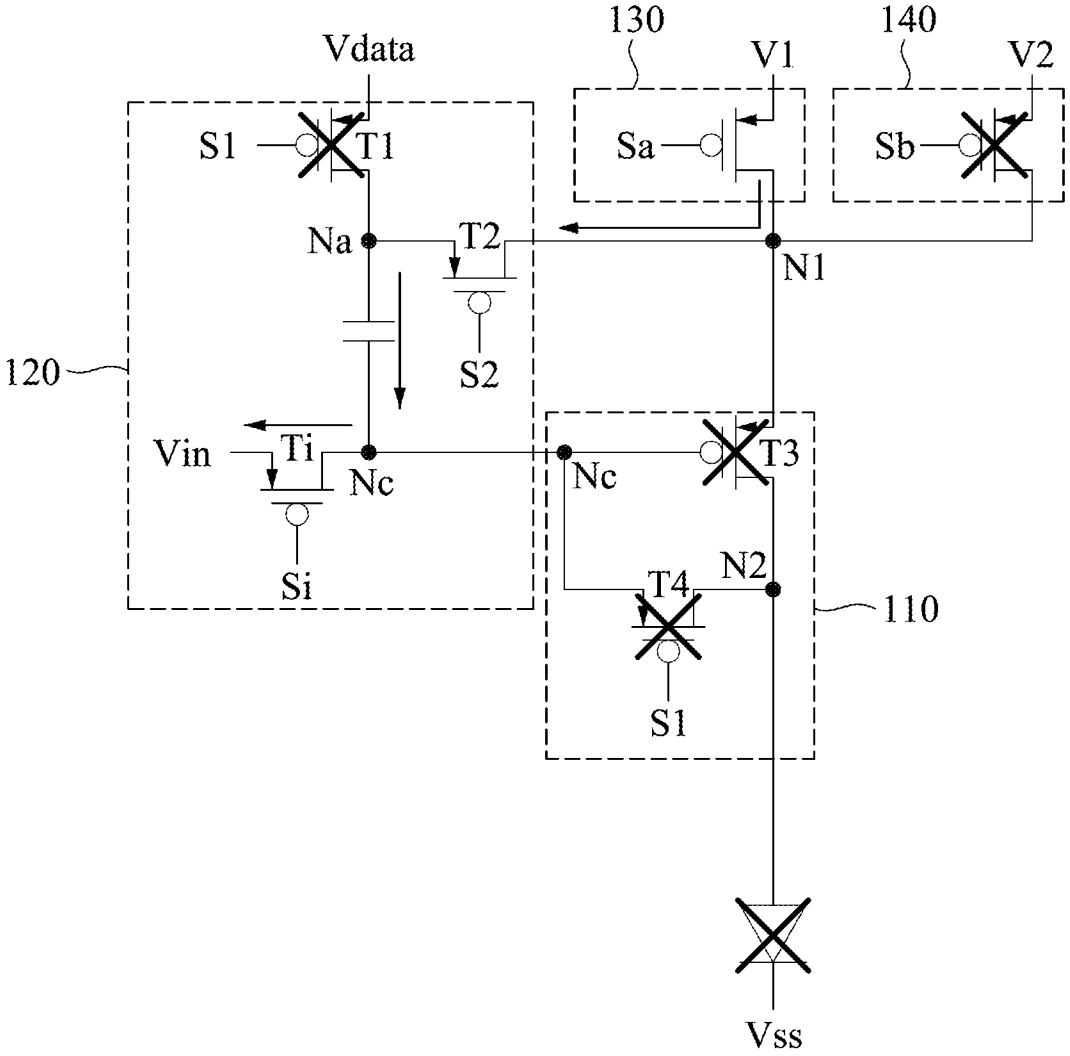
FIG. 3A is a schematic diagram of the pixel driver during the initialize period in some embodiments of the present disclosure.
Figure 3B:
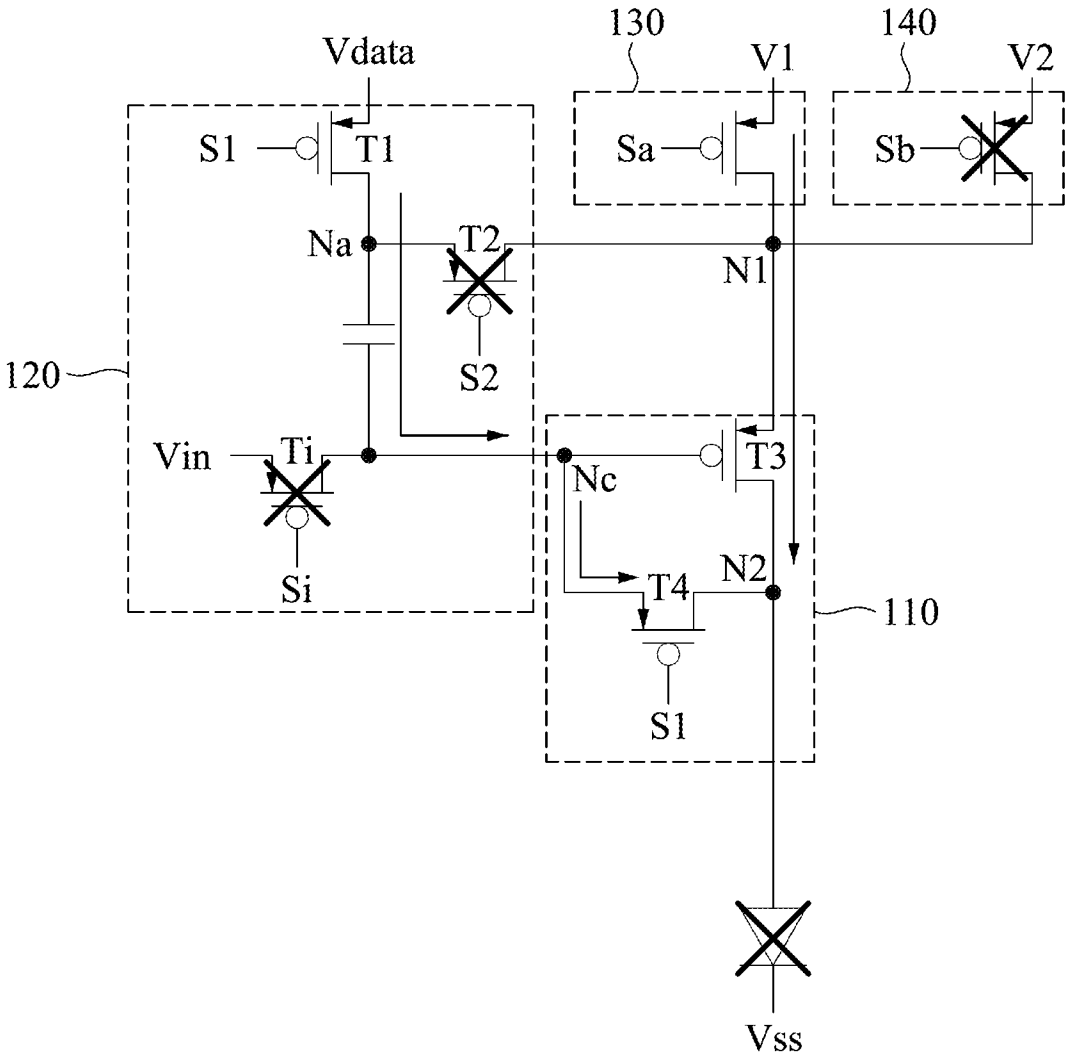
FIG. 3B is a schematic diagram of the pixel driver during the data input period in some embodiments of the present disclosure.
Figure 3C:
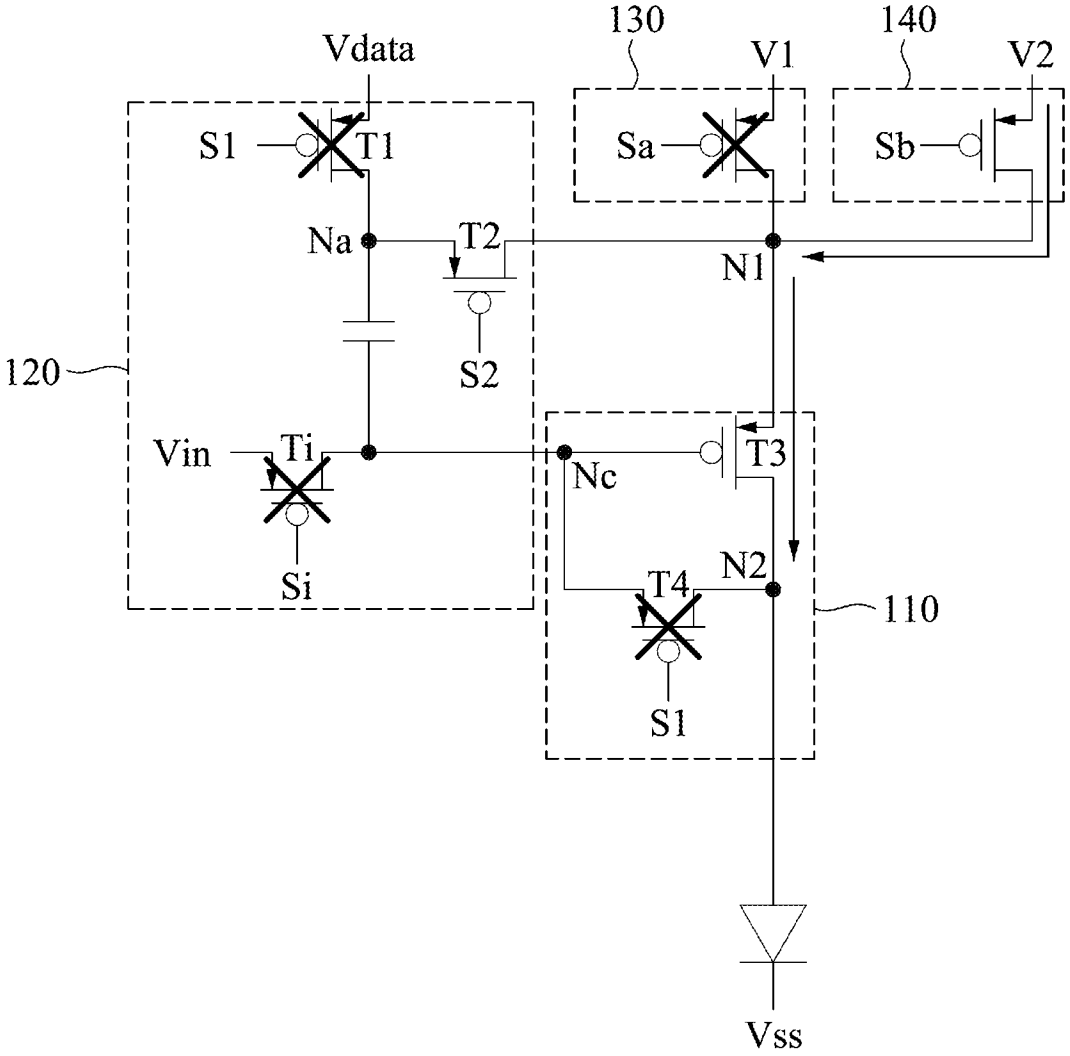
FIG. 3C is a schematic diagram of the pixel driver during the emission period in some embodiments of the present disclosure.
Figure 4:
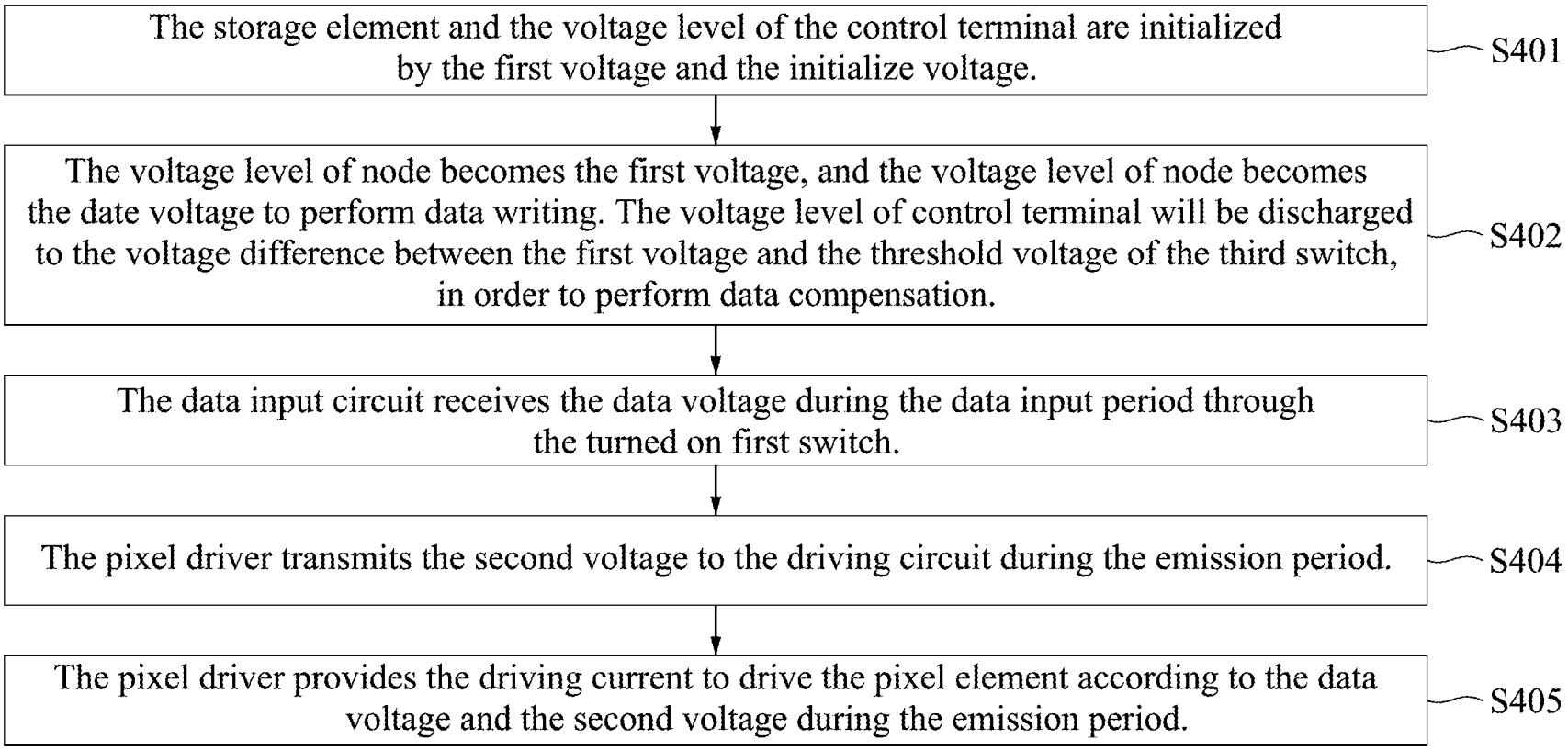
FIG. 4 is a flowchart illustrating a pixel driving method in some embodiments of the present disclosure.

FIG. 3A is a schematic diagram of the pixel driver 100 during the initialize period. FIG. 3B is a schematic diagram of the pixel driver 100 during the data input period. FIG. 3C is a schematic diagram of the pixel driver 100 during the emission period. FIG. 4 is a flowchart illustrating a pixel driving method in some embodiments of the present disclosure.

Referring to the FIG. 3A and FIG. 4, in step S401, the pixel driver 100 turns on the second switch T2, the first switch circuit 130 and the initialize switch Ti. The pixel driver 100 turns off the first switch T1, the second switch circuit 140, the third switch T3 and the fourth switch T4. At this time, the voltage level of the node N1, Na becomes the first voltage V1. The voltage level of the node Nc becomes the initialize voltage Vin. This time is called "initialize period". The storage element C1 and the voltage level of the control terminal (node Nc) are initialized by the first voltage V1 and the initialize voltage Vin. In this embodiment, the initialize voltage Vin is a low voltage level.

In step S402, referring to FIG. 3B, the pixel driver 100 turns on the first switch T1, the first switch circuit 130, the third switch T3 and the fourth switch T4. The pixel driver 100 turns off the second switch T2, the initialize switch Ti and the second switch circuit 140. This time is called "data input period". At this time, the voltage level of node N1 becomes the first voltage V1, and the voltage level of node Na becomes the date voltage Vdata to perform data writing. In some other embodiments, as shown in FIG. 2B, the node N1 is configured to receive the date voltage Vdata, so that the voltage level of node N1 becomes the date voltage Vdata. The node Na is configured to receive the first voltage V1, so that the voltage level of node Na becomes the first voltage V1. The date voltage Vdata may be written into the data input circuit 120 through the turned on third switch T3 and the fourth switch T4 to perform data writing.

At the same time, the voltage level of node Nc will be discharged to the voltage difference between the first voltage V1 and the threshold voltage of the third switch T3, in order to perform data compensation. The pixel driver 100 turns on the first switch circuit 130 to transmit the first voltage V1 to the driving circuit 110. In some embodiments, the voltage level of the second terminal N2 of the driving circuit 110 is less than an internal barrier voltage(Vth) of the pixel element P during the data input period, so that the pixel element P maintain is turned off.

In step S403, the data input circuit 120 receives the data voltage Vdata during the data input period through the turned on first switch T1. In step S404, referring to FIG. 3B, the pixel driver 100 turns on the second switch T2, the third switch T3 and the second switch circuit 140. The pixel driver 100 turns off the first switch circuit 130, the fourth switch T4, the initialize switch Ti and the first switch circuit 130. This time is called "emission period". The pixel driver 100 transmits the second voltage V2 to the driving circuit 110 during the emission period.

In step S405, the pixel driver 100 provides the driving current le to drive the pixel element P according to the data voltage Vdata and the second voltage V2 during the emission period. The pixel driver 100 may adjust the driving current le according to the voltage level of the control terminal Nc of the driving circuit 110. Accordingly, the voltage level of the nodes Na, Nc are not affected by noise from the second voltage V2, thereby ensuring that the compensation voltage level on the control node Nc is correct during the data input period.

Figure 5:
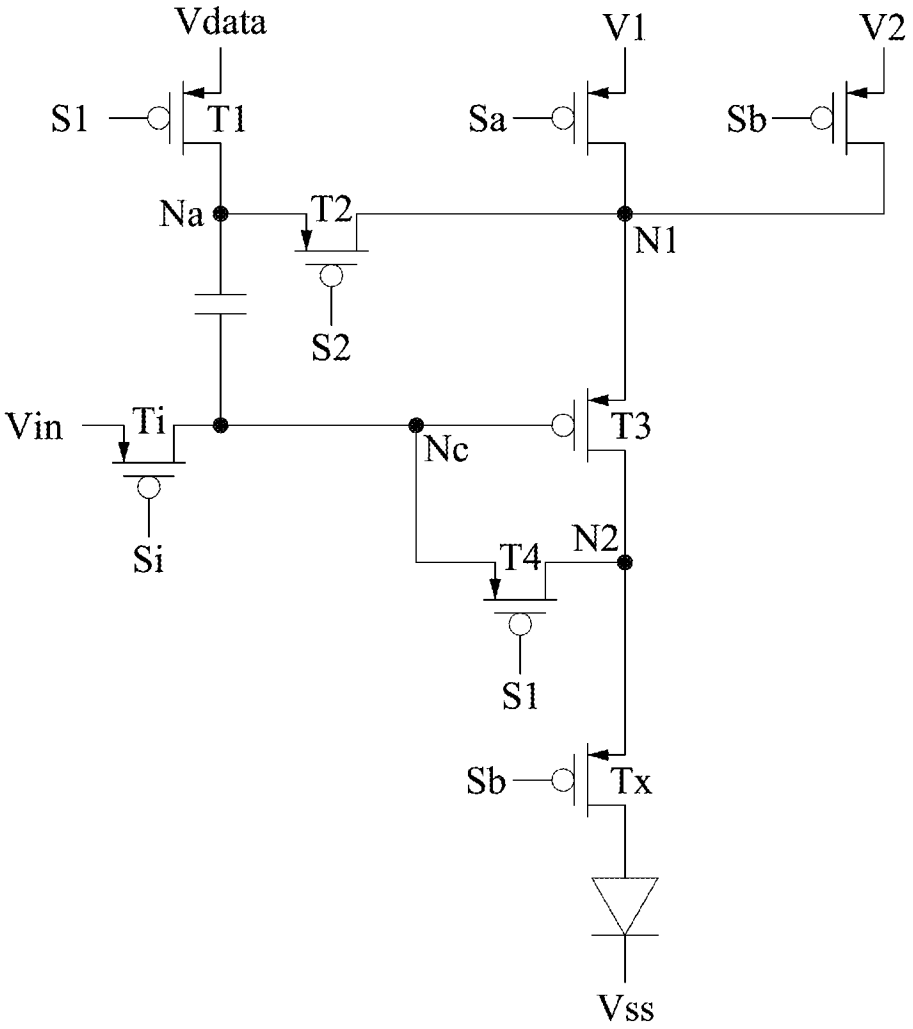
FIG. 5 is a schematic diagram of a pixel driver in some embodiments of the present disclosure.

Referring to FIG. 5. FIG. 5 shows the pixel driver 100 in another embodiment of the present disclosure. In FIG. 5, the similar components associated with the embodiment of FIG. 2 are labeled with the same number for ease of understanding. The specific principle of the similar component has been explained in detail in the previous paragraphs, and unless it has a cooperative relationship with the components of FIG. 5, it is not repeated here. The pixel driver 100 further includes an auxiliary switch Tx controlled by the control signal Sb. The auxiliary switch Tx is electrically coupled between the driving circuit 110 and the pixel element P. The auxiliary switch Tx is turn off, so that the pixel element P will not conduct to the first voltage V1 during the data input period, in order to ensure that the pixel element P is turned off.

Figure 6:
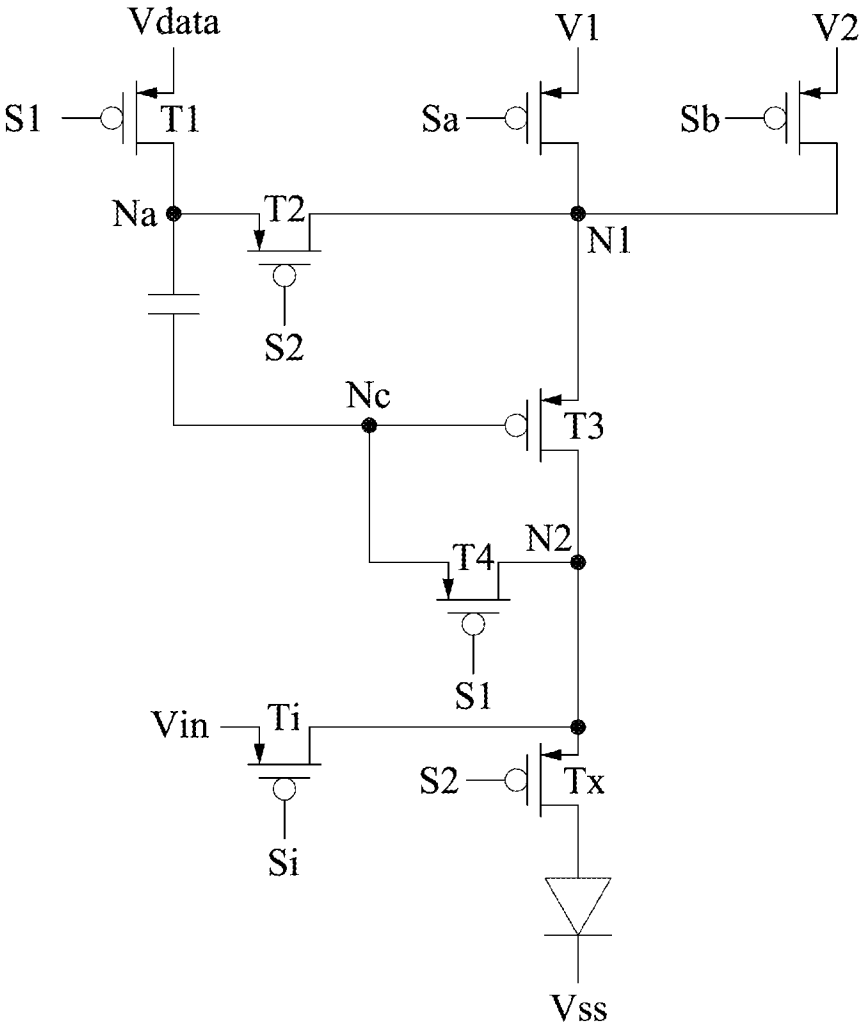
FIG. 6 is a schematic diagram of a pixel driver in some embodiments of the present disclosure.
Figure 7:
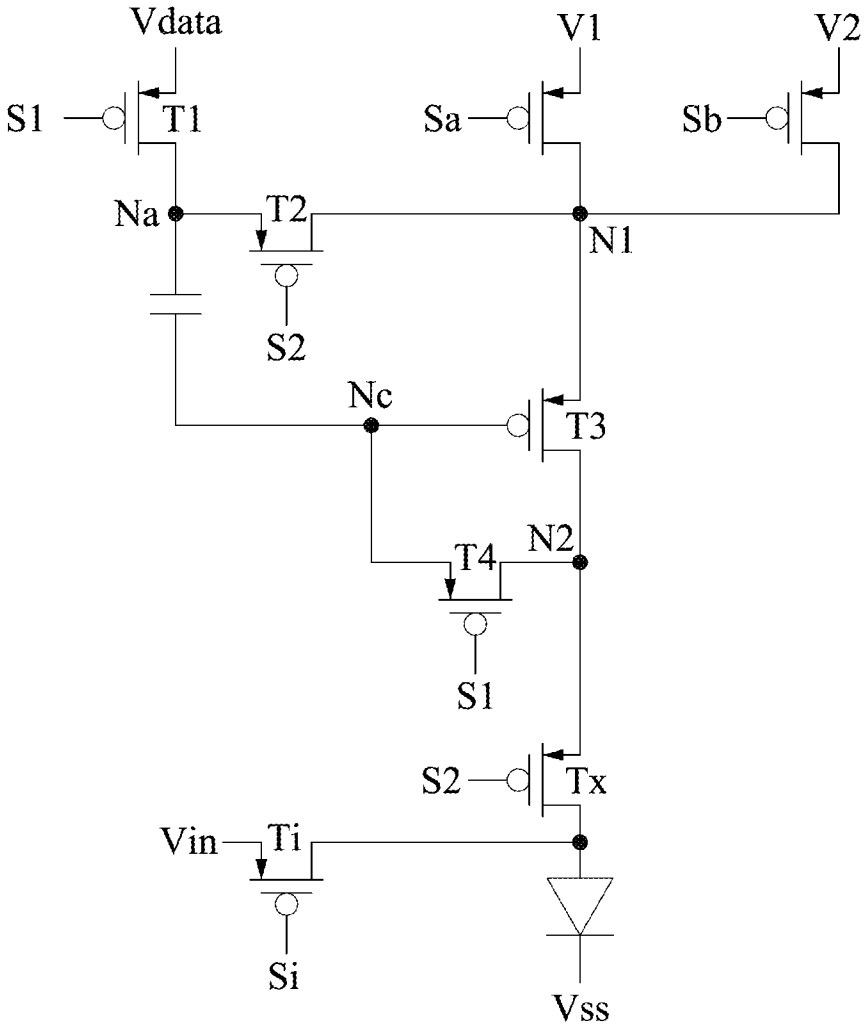
FIG. 7 is a schematic diagram of a pixel driver in some embodiments of the present disclosure.

Referring to FIG. 6 and FIG. 7, FIG. 6 and FIG. 7 show the pixel driver 100 in other embodiments of the present disclosure. In FIG. 6 and FIG. 7, the similar components associated with the embodiment of FIG. 2 are labeled with the same number for ease of understanding. The specific principle of the similar component has been explained in detail in the previous paragraphs, and unless it has a cooperative relationship with the components of FIG. 6 and FIG. 7, it is not repeated here.

Referring to the FIG. 6, the initialize switch Ti is electrically coupled to the pixel element P and the second terminal N2 of the driving circuit 110. During the initialize period, the pixel driver 100 turns on the second switch T2, the third switch T3, the fourth switch T4 and the initialize switch Ti. The pixel driver 100 turns off the first switch T1 and the auxiliary switch Tx. Accordingly, the initialize switch Ti may receive the initialize voltage Vin, and the voltage level of the control terminal (node Nc) becomes the initialize voltage Vin to perform data compensation.

Referring to the FIG. 7, the initialize switch Ti is electrically coupled between the pixel element P and the auxiliary switch Tx. Although the initialize voltage Vin is less than the internal barrier voltage of the pixel element P, and the auxiliary switch Tx is turned off during the initialize period and the data input period, the pixel element P will be turned off.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A pixel driver, comprising:

a driving circuit configured to provide a driving current to drive a pixel element during an emission period;

a data input circuit electrically coupled to the driving circuit, and configured to receive a data voltage during a data input period, the data input circuit being electrically coupled to a control terminal of the driving circuit, wherein the data input circuit comprises:

a first switch turned on to receive the data voltage during the data input period; and a storage element electrically coupled to the first switch and the control terminal of the driving circuit, wherein the storage element is configured to store the data voltage during the data input period;

an initialize switch electrically coupled to the storage element and the control terminal of the driving circuit, wherein the initialize switch is turned on to receive an initialize voltage during an initialize period before the data input period;

a first switch circuit electrically coupled to the driving circuit, wherein the first switch circuit is turned on to provide a first voltage to the driving circuit during the data input period; and a second switch circuit electrically coupled to the driving circuit, wherein the second switch circuit is turned on to provide a second voltage to the driving circuit during the emission period, and the first switch circuit is turned off during the emission period.

2. The pixel driver of claim 1, wherein the first switch circuit and the second switch circuit are electrically coupled to a first terminal of the driving circuit, the pixel element is electrically coupled to a second terminal of the driving circuit, and the driving circuit is configured to adjust the driving current according to a voltage level of the control terminal of the driving circuit.

3. The pixel driver of claim 2, wherein the data input circuit further comprises:

a second switch electrically coupled to the storage element and the first terminal of the driving circuit, wherein the second switch is turned on during the emission period.

4. The pixel driver of claim 2, wherein a voltage level of the second terminal of the driving circuit is less than an internal barrier voltage of the pixel element during the data input period.

5. The pixel driver of claim 2, further comprising:

an auxiliary switch electrically coupled between the driving circuit and the pixel element, wherein the auxiliary switch is turn off during the data input period.

6. The pixel driver of claim 2, wherein the driving circuit comprises:

a third switch electrically coupled between the first terminal of the driving circuit and the pixel element; and a fourth switch electrically coupled between a gate terminal of the third switch and a source terminal of the third switch.

7. The pixel driver of claim 6, wherein the fourth switch is turned on during the data input period, and the fourth switch is turned off during the emission period.

8. A pixel driver, comprising:

a driving circuit electrically coupled to a pixel element;

a data input circuit electrically coupled to a control terminal of the driving circuit, wherein the data input circuit comprises:

a first switch turned on to receive a data voltage during a data input period; and a storage element electrically coupled to the first switch and the control terminal of the driving circuit, wherein the storage element is configured to store the data voltage during the data input period;

an initialize switch electrically coupled to the storage element and the control terminal of the driving circuit, wherein the initialize switch is turned on to receive an initialize voltage during an initialize period before the data input period;

a first switch circuit electrically coupled to a first terminal of the driving circuit; and a second switch circuit electrically coupled to the first terminal of the driving circuit, wherein when the first switch circuit is turned on and the second switch circuit is turned off, the data input circuit is configured to receive the data voltage; and when the first switch circuit is turned off and the second switch circuit is turned on, the driving circuit is configured to provide a driving current to drive the pixel element.

9. The pixel driver of claim 8, wherein the driving circuit is configured to adjust the driving current according to a voltage level of the control terminal of the driving circuit.

10. The pixel driver of claim 9, wherein the data input circuit further comprises:

a second switch electrically coupled to the storage element and the first terminal of the driving circuit, wherein the second switch is turned on when the first switch circuit is turned off and the second switch circuit is turned on.

11. The pixel driver of claim 8, wherein the driving circuit comprises:

a third switch electrically coupled between the first terminal of the driving circuit and the pixel element; and a fourth switch electrically coupled between a gate terminal of the third switch and a source terminal of the third switch.

12. The pixel driver of claim 8, wherein the pixel element is electrically coupled to a second terminal of the driving circuit, when the first switch circuit is turned on and the second switch circuit is turned off, a voltage level of the second terminal of the driving circuit is less than an internal barrier voltage of the pixel element.

13. The pixel driver of claim 8, further comprising:

an auxiliary switch electrically coupled between the driving circuit and the pixel element, wherein the auxiliary switch is turned off when the first switch circuit is turned on and the second switch circuit is turned off.

* * * * *